US008051887B2

(12) United States Patent
Robinson et al.

(10) Patent No.: US 8,051,887 B2
(45) Date of Patent: Nov. 8, 2011

(54) PRIMARY AND COUNTER KNIFE ASSEMBLY FOR USE IN WOOD CHIPPER

(75) Inventors: Mark D. Robinson, Black River, NY (US); Scott J. Boliver, Croghan, NY (US)

(73) Assignee: CEM Machine, Inc., Carthage, NY (US)

( * ) Notice: Subject to any disclaimer, the term of this patent is extended or adjusted under 35 U.S.C. 154(b) by 246 days.

(21) Appl. No.: 12/612,354

(22) Filed: Nov. 4, 2009

(65) Prior Publication Data

US 2011/0100511 A1 May 5, 2011

(51) Int. Cl.
*B27C 1/00* (2006.01)
*B02C 19/00* (2006.01)
*B27L 11/00* (2006.01)

(52) U.S. Cl. ..... 144/373; 144/176; 144/163; 144/162.1; 241/92; 241/55; 241/152.2

(58) Field of Classification Search ..... 144/162.1, 144/163, 176, 373; 241/91, 92, 296, 55, 241/152.1, 152.2, 155
See application file for complete search history.

(56) References Cited

U.S. PATENT DOCUMENTS

| | | | |
|---|---|---|---|
| 2,172,449 | A | 9/1939 | Pelot et al. |
| 2,388,799 | A | 11/1945 | Payzer et al. |
| 2,566,721 | A | 9/1951 | Dunbar |
| 2,582,537 | A | 1/1952 | Flateboe |
| 2,825,371 | A | 3/1958 | Forman |
| 2,837,290 | A | 6/1958 | Nagel |
| 3,032,281 | A | 5/1962 | Wexell |
| 3,346,027 | A | 10/1967 | Kirsten |
| 3,410,495 | A | 11/1968 | Eklund |
| 3,635,410 | A | 1/1972 | Smith |

(Continued)

FOREIGN PATENT DOCUMENTS

WO WO 99/09242 2/1999

(Continued)

OTHER PUBLICATIONS

Earth Care Products Website; http://www.ecpisystems.com/wcms/index.php?burners; Jun. 17, 2008.

(Continued)

*Primary Examiner* — Shelley Self
(74) *Attorney, Agent, or Firm* — Hiscock & Barclay, LLP; R. Stephen Rosenholm

(57) ABSTRACT

A wood chipper having a rotatable disc that contains a series of slots that pass through the disc. A primary chipper knife is located at the entrance of each slot which separates slices from a work piece and directs the slices through the slot. A counter knife unit is mounted within each slot for engaging the slices leaving the primary chipper knife to reduce the size of the chips as they move through the slot. The counter knife unit contains a first series of spaced apart chip contact elements that have a first height to contact the slices as they leave the primary chipper knife to reduce the size of the slices. The counter knife further contains a second series of chip contact elements that have a second height that is less than that of the chip contact element in the first series. Each contact element in the second series is arranged to contact chips leaving the contact elements in the first series to further reducing the size of the chips.

13 Claims, 9 Drawing Sheets

U.S. PATENT DOCUMENTS

| | | | |
|---|---|---|---|
| 3,647,151 | A | 3/1972 | Artiano et al. |
| 3,661,329 | A | 5/1972 | Smith et al. |
| 4,134,554 | A | 1/1979 | Morlock |
| 4,140,282 | A | 2/1979 | Steimel |
| 4,155,384 | A | 5/1979 | Svenson |
| 4,198,887 | A | 4/1980 | Williams, Jr. |
| 4,346,744 | A | 8/1982 | Beer et al. |
| 4,390,132 | A | 6/1983 | Hutson et al. |
| 4,423,758 | A | 1/1984 | Haller et al. |
| 4,449,671 | A | 5/1984 | Martinez-Vera et al. |
| 4,480,667 | A | 11/1984 | Vaittinen et al. |
| 4,503,893 | A | 3/1985 | Demopoulos |
| 4,653,256 | A | 3/1987 | Saiia |
| 4,685,497 | A | 8/1987 | Mierau et al. |
| 4,690,337 | A | 9/1987 | Stiefel |
| 4,784,337 | A | 11/1988 | Nettles et al. |
| 4,827,989 | A | 5/1989 | Strong |
| 4,850,408 | A | 7/1989 | Carpenter et al. |
| 4,977,939 | A | 12/1990 | Depuy et al. |
| 5,060,873 | A | 10/1991 | Strong |
| 5,080,153 | A | 1/1992 | Waterman |
| 5,102,056 | A | 4/1992 | Ober |
| 5,129,437 | A | 7/1992 | Nettles et al. |
| 5,139,063 | A | 8/1992 | Nettles et al. |
| 5,155,975 | A | 10/1992 | Knowler |
| 5,236,024 | A | 8/1993 | Svensson et al. |
| 5,248,100 | A | 9/1993 | Arakawa |
| 5,274,899 | A | 1/1994 | Sentagnes et al. |
| 5,293,917 | A | 3/1994 | Kalliokoski |
| 5,323,975 | A | 6/1994 | Fulghum, Jr. |
| 5,348,064 | A | 9/1994 | Nettles et al. |
| 5,358,189 | A | 10/1994 | Vandermolen |
| 5,373,876 | A | 12/1994 | Tahkanen et al. |
| 5,390,865 | A | 2/1995 | Vandermolen et al. |
| 5,417,263 | A | 5/1995 | Jorgensen |
| 5,469,901 | A | 11/1995 | Leguin |
| 5,477,900 | A | 12/1995 | Gray |
| 5,655,582 | A | 8/1997 | Morin |
| 5,660,218 | A | 8/1997 | Jonkka |
| 5,667,152 | A | 9/1997 | Mooring |
| 5,678,294 | A | 10/1997 | Kokko |
| 5,727,611 | A | 3/1998 | Kalliokoski |
| 5,873,397 | A | 2/1999 | Lequin |
| 5,971,305 | A | 10/1999 | Davenport |
| 5,975,169 | A | 11/1999 | Jonkka et al. |
| 6,148,882 | A | 11/2000 | Nettles |
| 6,164,350 | A | 12/2000 | Olofsson et al. |
| 6,196,284 | B1 | 3/2001 | Lequin |
| 6,299,082 | B1 | 10/2001 | Smith |
| 6,484,770 | B1 | 11/2002 | Jonkka |
| 6,848,486 | B2 | 2/2005 | Heikkinen |
| 6,938,656 | B2 | 9/2005 | Plouffe et al. |
| 6,938,844 | B2 | 9/2005 | Castronovo |
| 6,941,987 | B2 | 9/2005 | Robinson |
| 6,976,516 | B2 | 12/2005 | Hale et al. |
| 7,267,146 | B2 | 9/2007 | Olofsson |
| 7,300,009 | B2 | 11/2007 | Dallimore et al. |
| 7,461,802 | B2 | 12/2008 | Smidt et al. |
| 7,669,621 | B2 * | 3/2010 | Nettles et al. ..... 144/176 |
| 7,681,819 | B2 | 3/2010 | McBride |
| 7,896,268 | B2 * | 3/2011 | Robinson et al. ..... 241/55 |
| 2004/0050453 | A1 | 3/2004 | Heikkinen |
| 2004/0060616 | A1 | 4/2004 | Jonkka et al. |
| 2006/0006259 | A1 | 1/2006 | Jonkka et al. |
| 2006/0086420 | A1 | 4/2006 | Olofsson |
| 2006/0174973 | A1 | 8/2006 | Jonkka |

FOREIGN PATENT DOCUMENTS

| | | | |
|---|---|---|---|
| WO | WO 01/56757 | A | 8/2001 |

OTHER PUBLICATIONS

Allegheny Pellet Corp. Website; http://www.woodpelletfuels.com/making.htm; Jun. 17, 2008.

New England Wood Pellet Website; http://www.pelletheat.com/core/aboutPellets/; Jun. 17, 2008.

Pellet Fuels Institute Website; http://www.pelletheat.org/3/news/facts.html; Jun. 17, 2008.

The Wider World of Pellet Fuel Website; http://www.pelletheat.org/3/news/index/htm; Jun. 17, 2008.

* cited by examiner

PRIMARY AND COUNTER KNIFE ASSEMBLY FOR USE IN WOOD CHIPPER

CROSS REFERENCE TO PATENT APPLICATIONS INCLUDING RELATED SUBJECT MATTER

This patent application includes subject matter that is related to subject matter that is included within U.S. patent application Ser. No. 12/401,930 now U.S. Pat. No. 7,896,268 and titled "Apparatus for Producing Small Size Wood Chips", filed Mar. 11, 2009.

This patent application also includes subject matter that is related to subject matter that is included within U.S. patent application Ser. No. 11/503,811 now U.S. Pat. No. 7,669,621 and titled "Stationary Bedknife For Disc Chipper Apparatus", filed Aug. 14, 2006.

FIELD OF THE INVENTION

This invention relates generally to a wood chipper and more specifically to an improved counter knife for enhancing the quality of wood chips produced from operation of a disc type wood chipper.

BACKGROUND OF THE INVENTION

Disc wood chippers typically contain a shaft 14 for rotating a disc about a horizontal axis. The disc typically includes a plurality of radially disposed slots. Primary chipping knives are mounted at the entrance to each slot which extend radially along the length of the opening. The blade of each primary knife protrudes outwardly from the front face of the disc in order to slice chips, also referred to as wood chip slices, from a wooden work piece that is brought into contact with the front face of the disc while it is rotating. The wood chip slices leaving the primary knives generally have a width that can equal the diameter of the material as measured in the plane of the disc at the chipper's feed opening and a length that is determined by various machine parameters. The width of the wood chip slices can be greater than the length of the wood chip slices leaving the primary knife. As a result, these wood chip slices often do not lend themselves for use in downstream processing units without further reduction of the size of the individual wood chip slices. Most machines for further reducing the size of the wood chips consume a substantial amount of energy.

Counter knives have been mounted in the slots of some chippers to engage the chip slices leaving the primary knives in order to further reduce the widths of the slices. These counter knife devices are generally not very efficient and fail to utilize a substantial portion of the energy that is carried by the chip slices leaving the primary chipping knife.

SUMMARY OF THE INVENTION

It is therefore an object of the present invention to improve the design of rotary disc wood chippers.

A further object of the present invention is to produce chips of a reduced size in a rotary disc chipper without the expenditure of additional energy.

A still further object of the present invention is to provide an improved counter knife system for use in a rotary disc chipper.

Another object of the present invention is to produce chips of a relatively small uniform size within the chip slots of a rotary disc chipper, and the same principles taught herein can be applied to a wide variety of disc chipper primary knife holding systems as well as to drum chippers that operate on very similar engineering principles.

These and further objects of the present invention are attained by a counter knife system that is mounted within each of the chip slots of a rotary disc chipper. The system includes a first series of spaced apart chip contact elements having a first height that are mounted in each chip slot for engaging chip slices coming off the primary knife to reduce the size of each slice. A further second series of spaced apart chip contact elements having a second height that is less than that of the first chip contact elements in the first series that are arranged to contact the chips leaving the first series of chip contact elements to further reduce the size of the chips.

BRIEF DESCRIPTION OF THE DRAWINGS

The objects and features of the invention can be better understood with reference to the claims and drawings described below. The drawings are not necessarily to scale; the emphasis is instead generally being placed upon illustrating the principles of the invention. Within the drawings, like reference numbers are used to indicate like parts throughout the various views. Differences between like parts may cause those like parts to be each indicated by different reference numbers. Unlike parts are indicated by different reference numbers.

DESCRIPTION OF THE INVENTION

Figure 1:
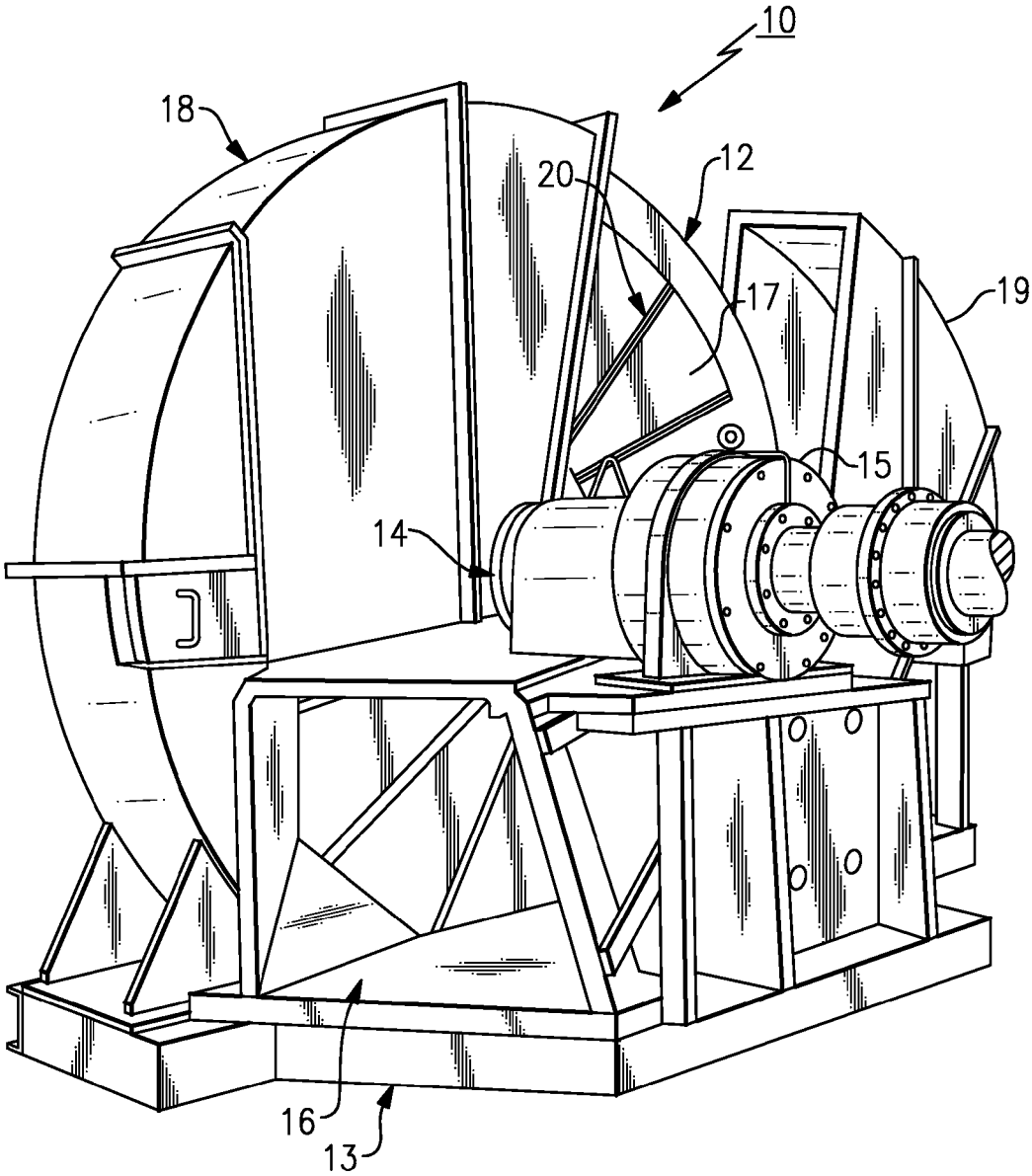
FIG. 1 is a perspective and external view of a rotary wood chipper that embodies the teachings of the present invention.

Turning initially to FIGS. 1-7, there is illustrated a wood chipper generally referenced 10, that embodies the present invention. The wood chipper includes a rotary disc 12 that is supported upon a horizontal shaft 14 within the machine frame. The shaft 14 is supported by a bearing 15 that is mounted upon the frame 13 and driven by a motor (not shown). The motor drives a shaft that is coupled to the horizontal shaft 14 of the wood chipper. A horizontally disposed feed spout 16 is located below the shaft 14 and arranged to conduct wooden work pieces into contact with the front face 17 of the disc. The disc is enclosed within a protective casing generally referenced 18. A portion of the casing 19 is shown moved back in FIG. 1 to reveal the front face 17 of the disc. A series of spaced apart, radially disposed chip slots 20 are formed through the disc between the front face 17 and the rear face 21 (FIG. 3) of the disc.

Figure 2:
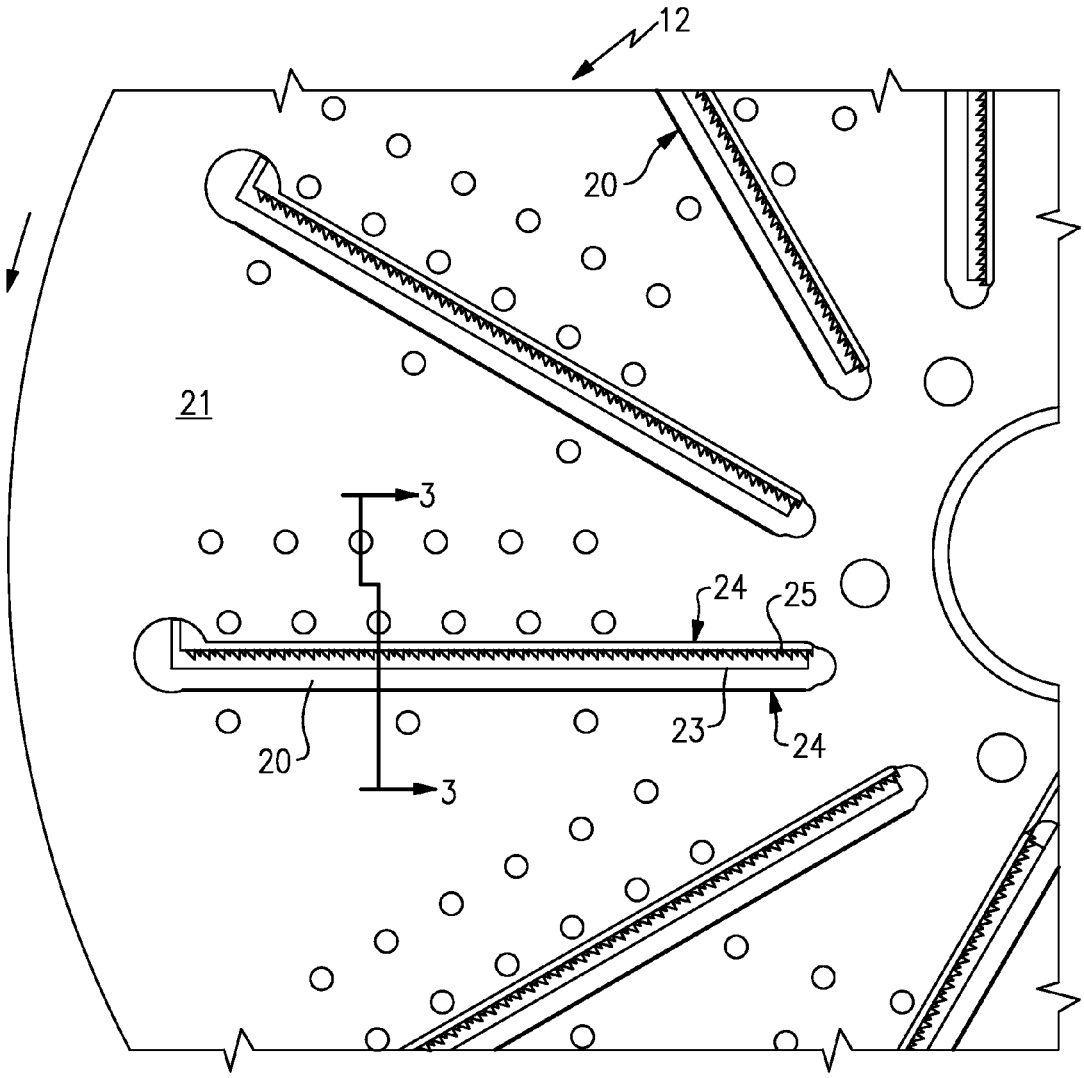
FIG. 2 is an enlarged partial view of a rear face of a rotatable disc including a plurality of chip slots.
Figure 3A:
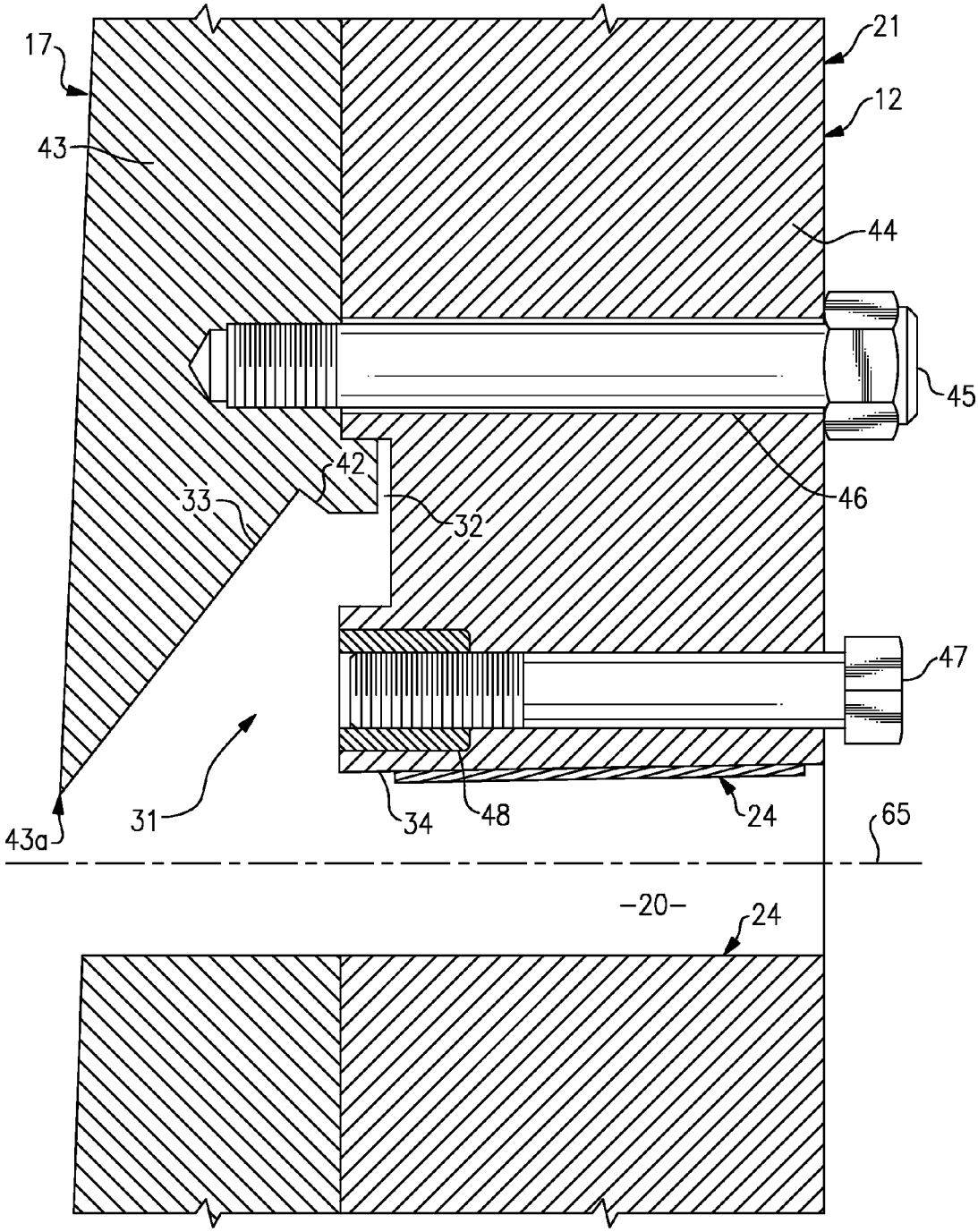
FIG. 3A is a further enlarged cross sectional view taken along lines 3-3 in FIG. 2 showing a cross sectional view of a chip slot excluding primary chipping and counter knifes, and counter knife carriage.
Figure 3B:
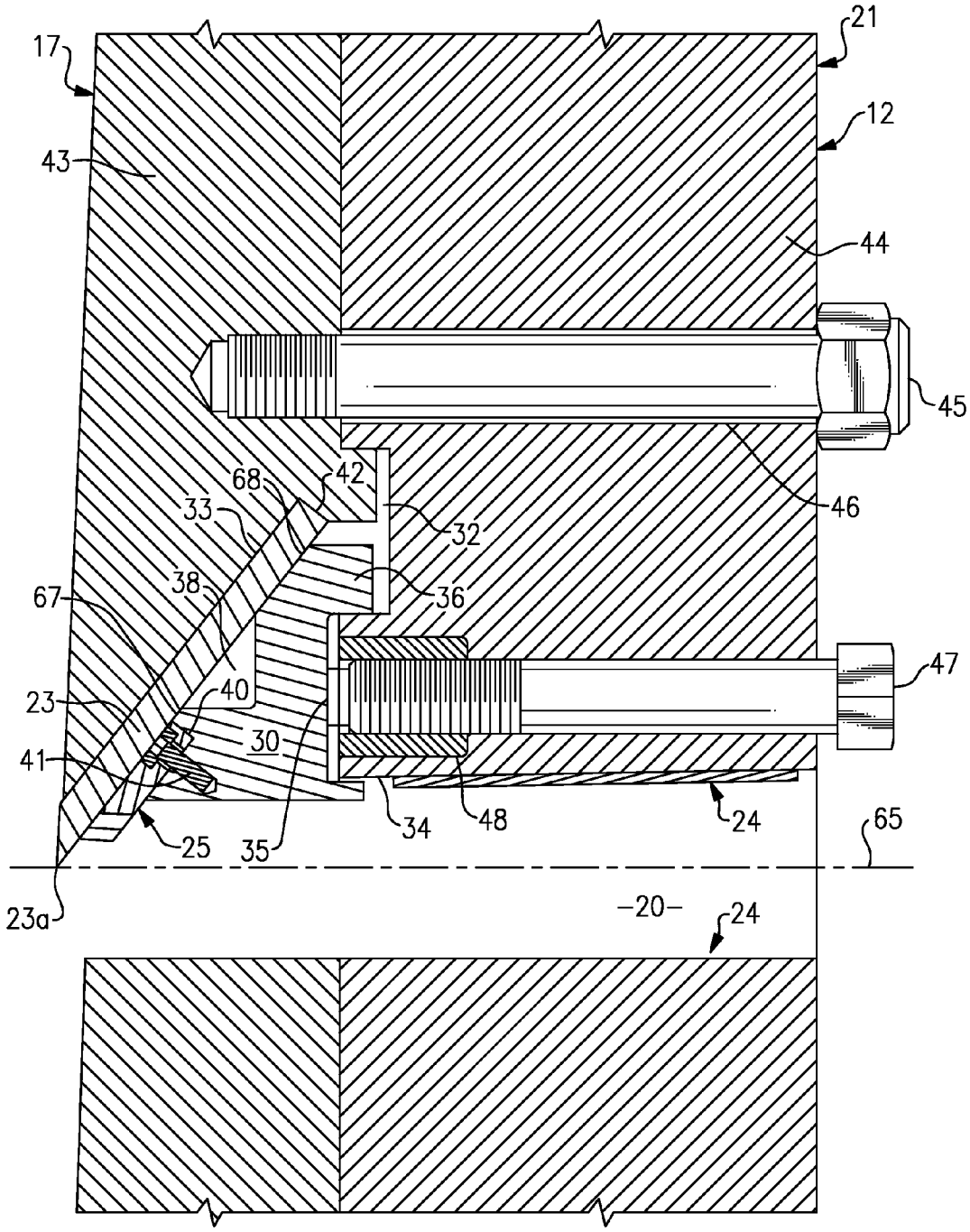
FIG. 3B is a further enlarged cross sectional view taken along lines 3-3 in FIG. 2 showing a cross sectional view of a chip slot including primary chipping and counter knives, and counter knife carriage.
Figure 4:
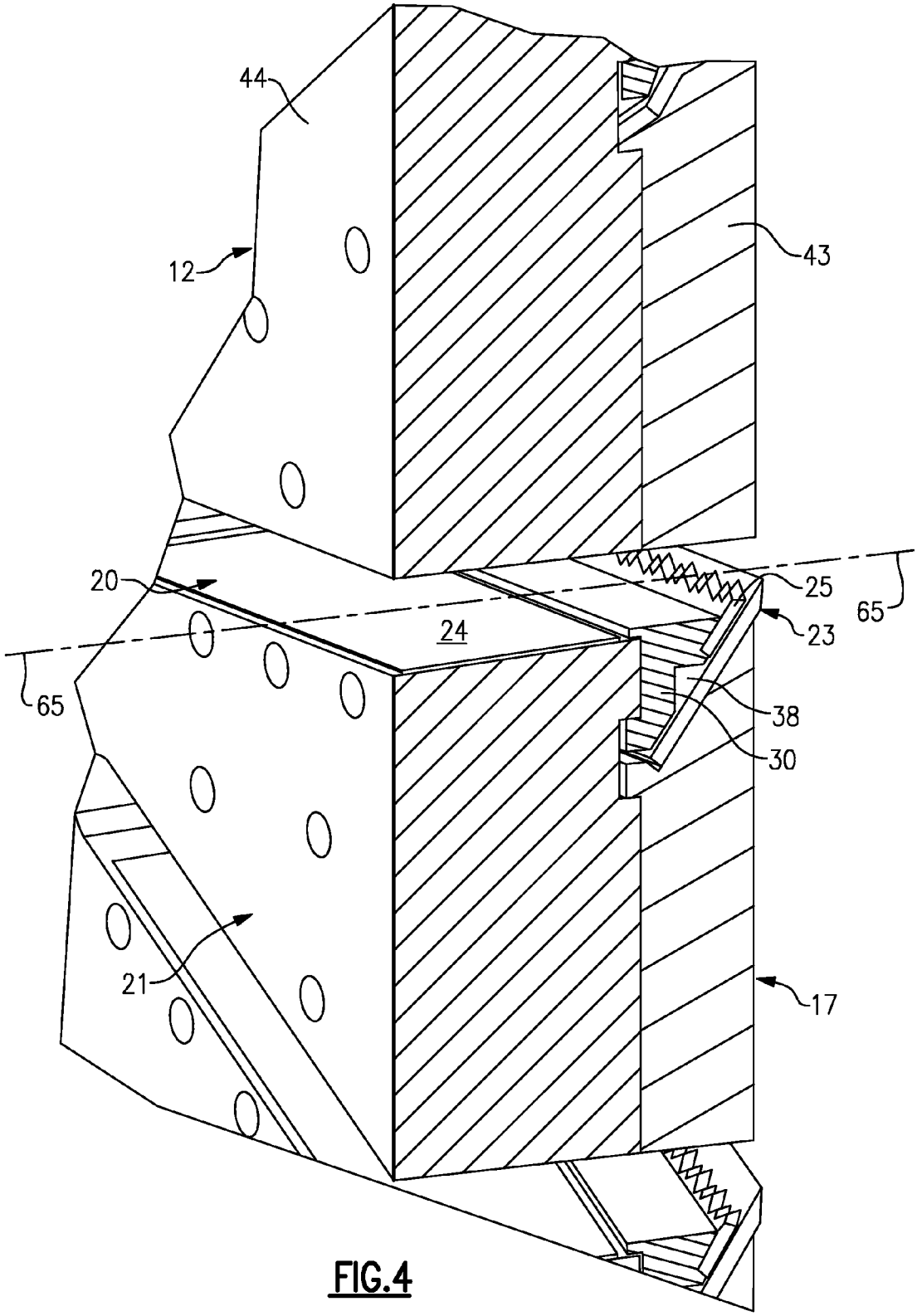
FIG. 4 is an enlarged partial perspective and cross sectional view showing a mounting arrangement for the primary chipping and a counter knives.

As best illustrated in FIGS. 2-4, a primary chipper knife 23, also referred to as the primary knife 23, is mounted at an entrance of each chip slot 20. The primary knife 23 includes a sharp tip 23*a*. The chip slot includes a radial wall 24. The primary knife 23 is arranged to slice chips of wood away from wooden work pieces (not shown) that are brought into contact with the front face 17 of the rotating disc via the feed spout 16. A sharp edge of the primary knife, also referred to as the primary knife blade, directs the chip slice into and through an associated slot 20 by centrifugal forces generated by the rotating disc, as well as by shearing forces of the primary knives acting on the chip slices cut from the wood work pieces, and by any gravitational (for chippers arranged with logs fed by gravity) or log infeed conveyor forces (wood work piece powered conveyance to the chipper not shown in figures) acting on the wood work pieces.

Within each slot, a counter knife unit 25 is mounted adjacent to the primary knife 23 in order to engage each of the wood slices leaving the primary chipper knife 23. Both the primary chipper knife 23, also referred to as the primary knife 23 and the counter knife 25 are supported upon a support bracket, also referred to herein as a carriage 30, that is mounted to the disc 12 within a cavity 31 along the radial interior wall 24 within each slot 20. The cavity 31 is also referred to herein as a V-shaped opening 31. The cavity 31 includes a base surface 32 that runs generally parallel to the front 17 and rear 21 surfaces of the disc 12 and an inclined wall surface 33 that forms an acute angle relative to the front surface 17 of the disc.

Referring to FIGS. 3A-3B, the counter knife 25 abuts an interior facing surface, also referred to as a rear surface of the primary chipper knife 23, while both knives 23, 25 are installed within the chipper disc 12. The counter knife 25 is held within a notch 40 that is located on the carriage 30, by a plurality of screws 41 (not fully shown) that pass through the counter knife 25 and that are threaded into a wall of the carriage 30.

The rear surface of the primary chipper knife 23 rests against an inclined portion 67 and inclined portion 68 of the carriage 30. The inclined portion 67 being adjacent to the notch 40 of the carriage 30. The carriage 30 can further include a V-shaped notch 38 that is located between inclined portion 67 and inclined portion 68 of the carriage 30. The V-shaped notch 38 enables easier removal of the carriage 30 from the disc 12 by providing more room to negotiate movement of the carriage 30 around the tip 43*a* of the front section 43 and holder for the primary knife blade 23 during installation and removal of the carriage 30 from the disc 12. (The primary knife blade 23 is first removed from the assembly to permit removal of the carriage 30). The rear surface of the primary chipper knife (blade) 23 is in coplanar alignment with inclined surfaces 67 and 68 of the carriage 30. The primary knife 23, as assembled and installed, resides in a notch 42 formed in the inclined wall 33 of the chip slot side of the primary knife blade holder 43 also called the front section of the disc within the cavity 31.

Figure 5:
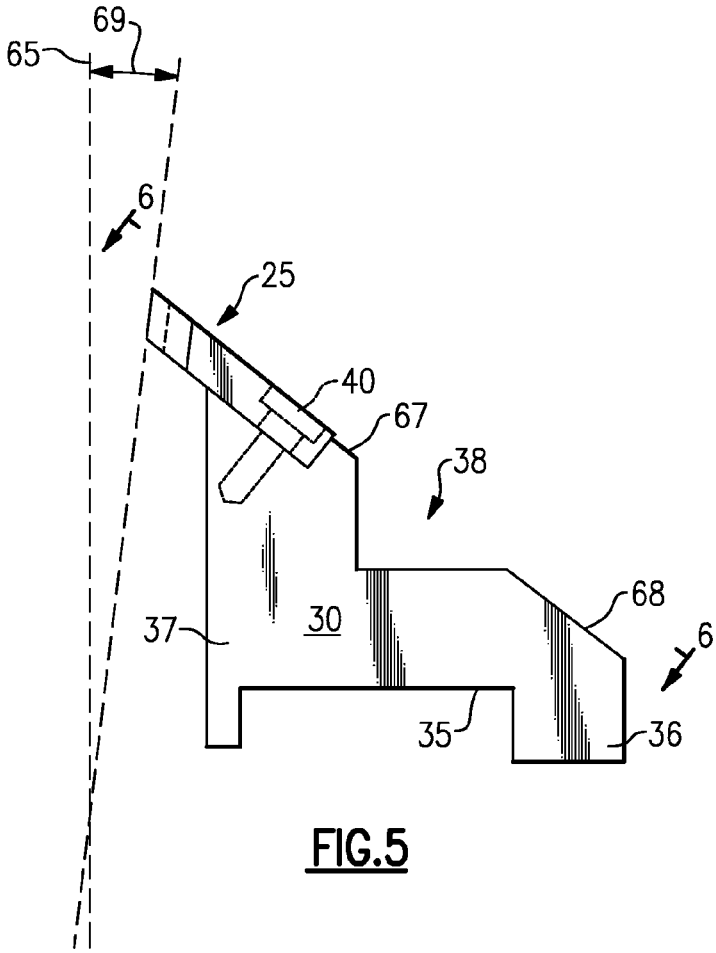
FIG. 5 is a side elevation showing a support bracket (carriage) for mounting a counter knife unit within a chip slot of the rotatable disc.

As illustrated in FIG. 3B the disc 12 includes a front section and primary knife blade holder 43 and a rear section 44. The two sections are held together in face to face contact by a plurality of bolts 45 that pass through clearance holes 46 in the rear section 44 and that are threaded into the primary knife blade holder 43 and front section 43 of the disc. Pressing and tightening the two sections together causes the cut out 35 in the base of the carriage 30 to receive and capture the raised boss 34 in the triangular shaped cavity 31 adjacent to the raised boss 34 in order to properly position the carriage 30 in the cavity 31 as the front 43 and rear 44 sections are brought together into one assembly. As shown in FIG. 5, the carriage 30 includes a side wall 37 that is oriented substantially parallel (typically within +/−20 degrees) to the longitudinal axis 65.

A second series of bolts 47 are passed upwardly through the rear section 44 of the disc 12 and are mated with threaded inserts 48 that are press fitted into the raised boss 34 located proximate a radial wall of each slot 20. Turning the bolts 47 in the threaded inserts advances the bolts into contact with the base wall 36 of the associated carriage 30 and thus driving the carriage 30 and the primary and counter knife blades 23, 25 supported thereon into arresting contact against the inclined wall 33 within the cavity 31 and thus locking the blades 23, 25 in place.

Figure 6:
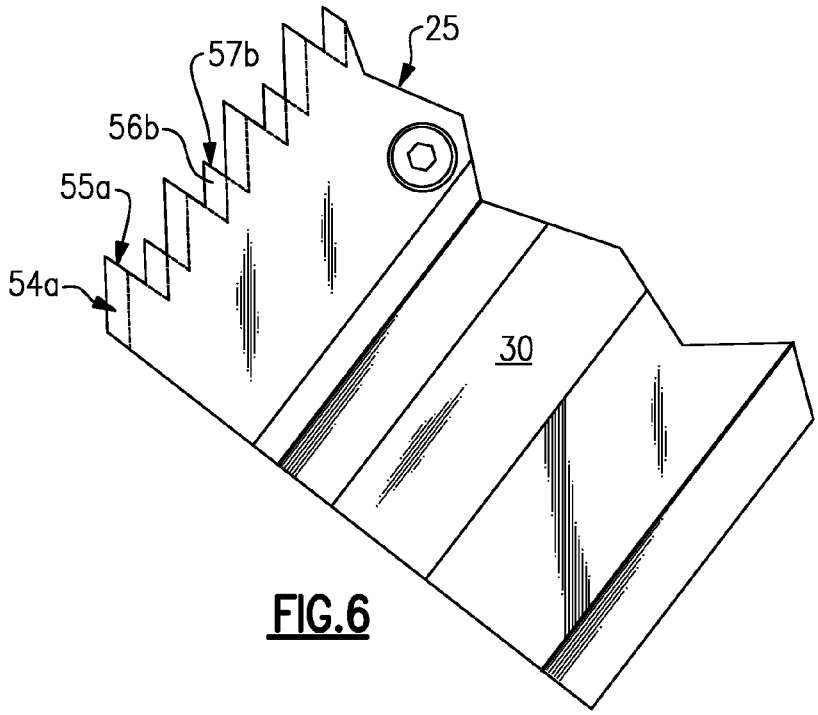
FIG. 6 is a partial view taken along line 6-6 in FIG. 5.
Figure 7:
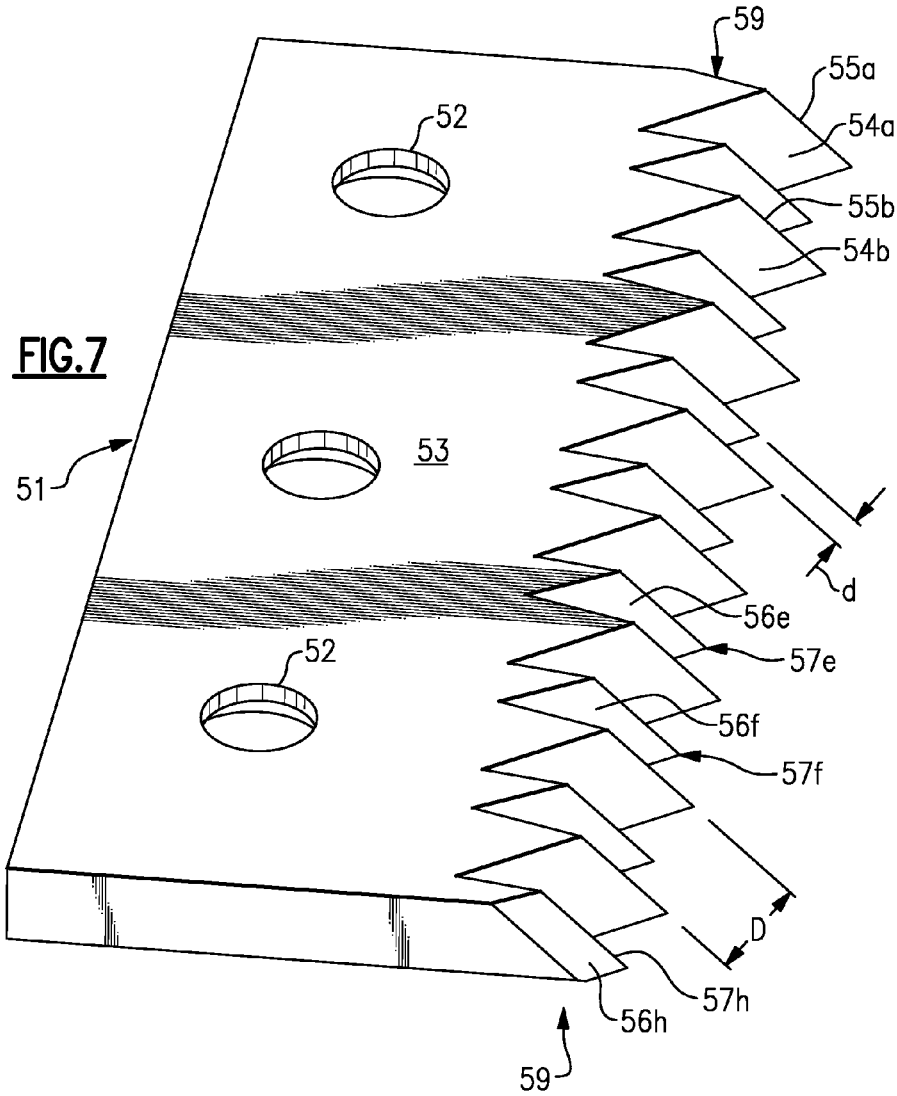
FIG. 7 is an enlarged perspective view of one embodiment of a counter knife unit embodying the teachings of the present invention.

The geometry of a first embodiment of the counter knife unit 25 is shown in greater detail in FIGS. 5-7. As best illustrated in FIGS. 5 and 7, the counter knife unit 25 includes a number of aligned coplanar sections 51, each of which is secured to the carriage 30 as described above by means of screws 41 (See FIG. 3) that are seated within countersunk holes 52-52. Each section of the counter knife 25 includes a rectangular pedestal 53, that has a series of contact elements 59, also referred to as cutting elements 59, that are located along a top edge of the pedestal 53.

The contact elements 59 include a first series of cutting elements 54*a*-54*h*, also referred to herein as blade teeth 54*a*-54*h*, that extend upwardly from the pedestal 53 to a first height and which each terminate with a linear cutting edge 55*a*-55*h* that passes across the width of the pedestal 53. When the counter knife 25 is mounted upon the carriage 30, the cutting edges 55*a*-55*h* of the cutting elements 54*a*-54*h* are arranged to engage wood chip slices as they leave the primary knife 23. In response to the speed of the rotating disc 12 the wood chips that engage the cutting edges 55*a*-55*h* possess a substantial amount of kinetic energy and as a result, are either sliced or broken into a smaller chips that each have a width that is about equal to the distance (D) that separates each of the adjacent cutting edges 55*a*-55*h*.

A second series of shorter chip cutting elements 56*a*-56*h* are also supported along the top edge of the pedestal 53. Each shorter cutting element 56*a*-56*h*, like its taller counterpart 54*a*-54*h*, includes a linear cutting edge 57*a*-57*h* that also extends across the top edge of the pedestal 53. Each of the shorter cutting elements 56*a*-56*h* occupies space between two adjacent taller chip cutting elements 54*a*-54*h*. The shorter cutting elements 56*a*-56*h* are situated so that they engage wood chips leaving the first series of chip contact elements 54*a*-54*h* to further reduce the size of the processed wood chips. Preferably the cutting edges 57*a*-57*h* of the shorter cutting elements 56*a*-56*h* are parallelly aligned with the cutting edges 55*a*-55*h* of the taller cutting elements 54*a*-54*h* and are arranged a given distance (d) from a cutting edge of one of the adjacent taller cutting elements 54*a*-54*h* such that the wood chips that are engaged by the shorter cutting elements 56*a*-56*h* are each generally bisected into (2) approximately equal sized pieces. The distance 'd' may vary from machine to machine depending upon the varying operating characteristics of the machine.

As noted above, counter knife 25 systems utilizing chip contact elements of a single uniform height are known and employed in the prior art. In these prior art systems, the chips slices leaving the primary knife contain an amount of energy only a portion of which is consumed as the chip slice passes into the contact elements of the counter knife 25. In addition, a portion of the wood chips in process tends to slide over the contact elements thus producing incomplete chip separation and resulting in wood chips of a non-uniform size and shape. The presented system described herein overcomes some of these disadvantages in that the multi height arrangement of the contact elements more efficiently utilizes the available energy and uniformly distributes the energy over the blade array to produce more complete and uniform separation and sizing of the processed wood chips.

Figure 10A:
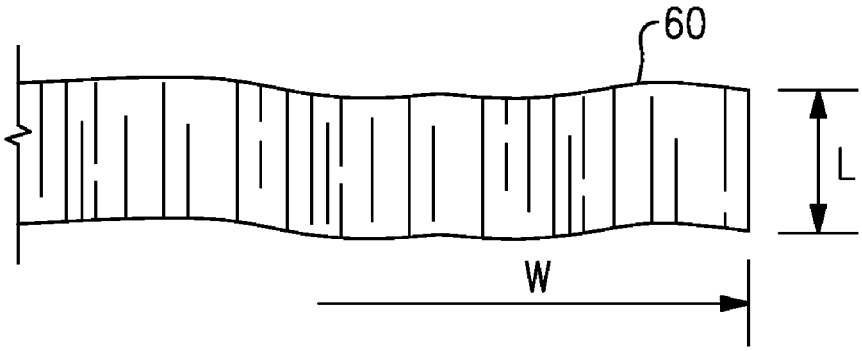
FIG. 10A is an enlarged side view depicting a typical wood chip slice as it leaves the primary knife of a wood chipper.
Figure 10B:
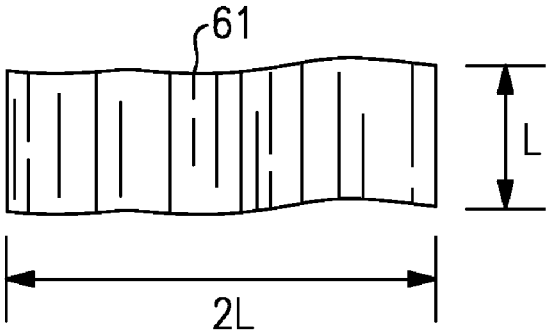
FIG. 10B depicts a typical chip size as it leaves the first series of chip contact elements contained in the present counter knife unit.
Figure 10C:
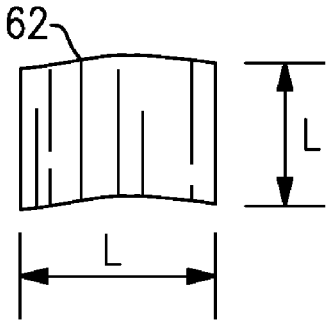
FIG. 10C depicts a typical chip size as it leaves the second series of chip contact elements contained in the present counter knife unit.

As illustrated in FIG. 10A-10C, the ribbon like wood chips 60 leaving the primary knife 23 will have a width 'W' that is determined by the size and shape of the work piece as well as the machine's operating parameters. The length 'L' of the ribbon will remain fairly constant.

In the preferred embodiment of the invention as described above, the spacing between the wood chip contact elements in the first tier of higher chip contact elements 54*a*-54*h* is maintained at a distance that is about twice the final desired width of chip which could be selected to be more or less equal to the length of the ribbon so that generally rectangular chips 61 are for instance produced having a width that is about twice the length of the chips width. By locating the chip contact elements of the second lower tier of elements 56*a*-56*h* about midway between the elements in the first higher tier, the wood chips leaving the first higher tier of elements are substantially bisected into (2) pieces and thus in this instance producing wood chips 62 having length that substantially equals the desired wood chip width. It has been found that this arrangement of tier and chip contact element spacing provides for an efficient and equal distribution of available energy between tiers of cutting elements and results in the production of more uniform sized and higher quality wood chips.

It has been further found that the effectiveness of the multi tiered wood cutting design can be further enhanced by inclining the chip contact elements toward the direction of rotation of the disc as well as angularly offsetting the elements to one side or the other of longitudinal axis 65 of the chip slots 20. Angular offsets of 20° to either side of the slot axis can be tolerated by the system. As shown in FIG. 5, an angular offset 69 is shown to be within 20° of the longitudinal axis 65 of the slot 20.

Figure 8:
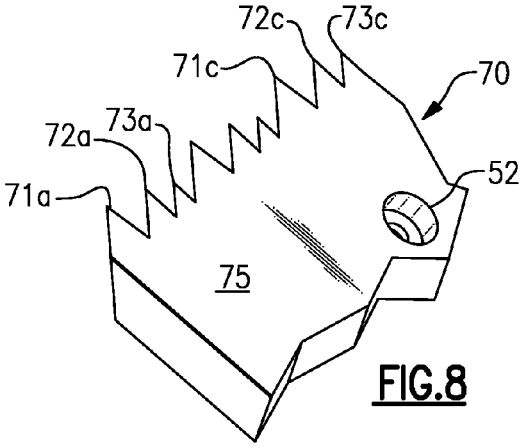
FIG. 8 is a partial perspective view showing a counter knife segment suitable for use in the present invention.
Figure 9:
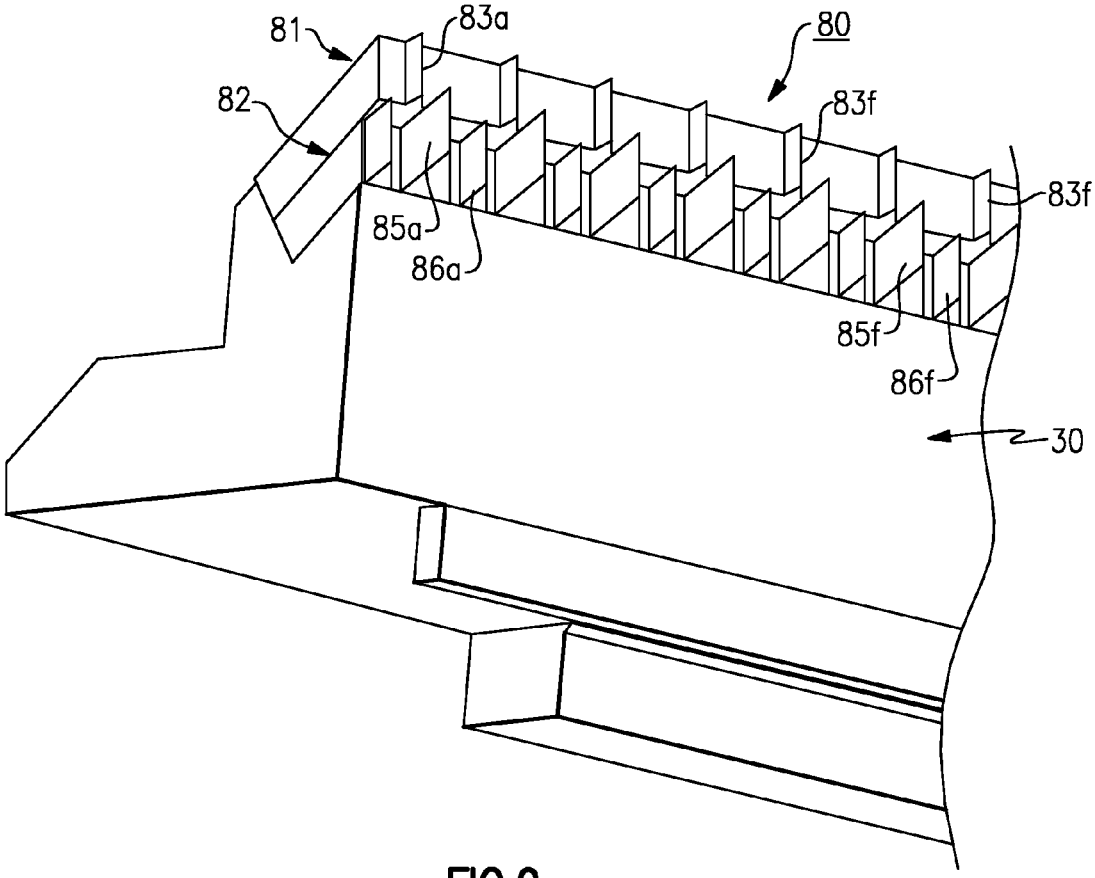
FIG. 9 is a partial perspective view showing a further embodiment of a counter knife arrangement suitable for use in the present invention.

FIGS. 8 and 9 illustrate a further embodiment of the invention in which the another embodiment of a counter knife unit 70 contains cutting elements in a three tier arrangement wherein the height of cutting elements vary from tier to tier. As shown in FIG. 8, the counter knife 70 in this embodiment is similar in construction as that shown in FIG. 6 in that a group of (3) three chip contact elements 71*a*, 72*a* and 73*a* are mounted in a side by side relationship in descending order upon a rectangular shaped support pedestal 75. As shown, the counter knife 70 includes (3) groups 71, 72 and 73 of chip contact elements where each group includes (3) chip contact elements 71*a*-71*c*, 72*a*-72*c* and 73*a*-73*c*. Here again this embodiment of the counter knife 70 is mountable within a carriage 30 and is arranged so that the ribbon shaped wood chips that are sliced from a work piece by the primary knife blade 23 move in a series of three steps through the counter knife 70 unit to provide a relatively smaller and higher quality chip as compared to typical prior art produced wood chips.

Turning now to FIG. 9 there is shown still another embodiment of the invention in which the counterblade unit 80 comprises an upper knife 81 and a lower knife 82. The upper knife contains a first series of contact elements 83*a*-83*f* that are arranged to initially contact chip slices leaving the primary knife 23 and to separate the slices into chips having a length that is defined by the spacing between the contact elements 83*a*-83*f*.

The lower knife 82 contains a second series of chip contact elements 85*a*-85*f* and a third series of chip contact elements 86*a*-86*f*. Each contact element 86*a*-86*f* in the third series is positioned between two of the contact elements 85*a*-85*f* in the second series of elements and is shorter in height than the neighboring elements 85*a*-85*f*. The second tier of chip contact elements 85*a*-85*f* are arranged to engage the chips leaving the first tier of contact elements and the third tier of contact elements 86*a*-86*f* are arranged to engage the chips leaving the second tier of contact elements 85*a*-85*f*.

PART LIST

The following Parts List summarized drawing reference numbers used within the invention description.

10 wood chipper
12 disc
13 frame
15 bearing
16 feed spout
17 front face
18 protective casing
19 casing
20 chip slot
21 rear face
23 primary knife or primary chipper knife
24 radial wall
25 counter knife unit
30 carriage
31 V-shaped opening
32 base surface
33 inclined wall
34 raised boss
35 cut out
36 base wall
38 V-shaped notch
40 recessed notch
41 screws
42 notch
43 front section or primary knife blade holder
43*a* tip area
44 rear section
45 bolt
46 clearance hole
47 bolt
48 threaded inserts
51 coplanar sections
52 counterbored holes
53 pedestal
54*a*-54*h* cutting elements (also referred to as blade teeth 54*a*-54*h*)
55*a*-55*h* cutting edges
56*a*-56*h* cutting elements
57*a*-57*h* cutting edge
59 contact elements
60 wood chips

61 rectangular chips
62 wood chips
65 longitudinal axis
67 inclined portion
68 inclined portion
69 angular offset
70 counter knife unit
71*a* contact element
72*a* contact element
73*a* contact element
75 pedestal
80 counterblade unit
81 upper knife
82 lower knife
83*a*-83*f* contact elements
85*a*-85*f* contact elements
86*a*-86*f* contact elements While the present invention has been explained with reference to the structure disclosed herein, it is not confined to the details set forth and this invention is intended to cover any modifications and changes as may come within the scope and spirit of the following claims.

The invention claimed is:

1. Apparatus for producing wood chips that includes:

a rotatable disc having a series of spaced apart radially extended slots passing between a front face and a rear face of said disc;

a primary chipper knife mounted along a radial wall of each slot at the entrance to said each slot for slicing chips from a wooden work piece that is placed in contact with the front face of said disc and directing said chips into said each of said slots;

a counter knife unit mounted within each of said slots behind said primary chipper knife;

said counter knife unit further including a first series of chip contact elements each having a first height for initially engaging chips leaving said primary chipper knife to reduce the size of said chips;

said counter knife unit further including a second series of chip contact elements each having a second height that is less than the height of said first chip contact elements and being arranged to engage said chips leaving said first series of contact elements to further reduce the size of said chips.

2. The apparatus of claim 1 wherein each chip contact element contains a linear blade for engaging chips as said chips move through said slots to reduce the size of said chips.

3. The apparatus of claim 2 wherein said blades are inclined toward the direction of rotation of said disc.

4. The apparatus of claim 3 wherein each blade contains a linear cutting edge that is generally aligned along the longitudinal axis of each slot.

5. The apparatus of claim 3 wherein each blade contains a linear cutting edge that is offset from the longitudinal axis of each slot at an angle of between 0° and 20°.

6. The apparatus of claim 2 wherein the first and second series of chip contact elements are integrally attached to a common base.

7. The apparatus of claim 6 wherein each of the chip contact elements in said second series are situated between a pair of chip contact elements in said first series.

8. The apparatus of claim 7 wherein each of said chip contact elements in said second series is arranged to contact chips leaving said first series of chip contact elements about midway along the width of the chips leaving said first series of contact elements.

9. The apparatus of claim 2 wherein said chip contact elements of said first series are mounted upon a first base and said chip contact elements in said second series of contact elements are mounted upon a second base.

10. The apparatus of claim 9 wherein said second base is mounted in contact with said first base.

11. The apparatus of claim 1 that further includes a third series of chip contact elements each having a third height that is less than said second height of the chip contact elements in said second series of chip contact elements and which are arranged to engage chips leaving said second series of chip contact elements to further reduce the size of said chips.

12. The apparatus of claim 11 wherein each of the chip contact elements in said third series is situated between one of the chip contact elements in said second series and one of the chip contact elements in said first series.

13. A method of producing wood chips within a wood chipping machine having a rotatable disc that contains radially disposed slots that pass through said disc, said method including the steps of:

mounting a primary knife at the entrance of each slot for separating chips from work pieces that are brought into contact with said rotating disc and directing said chips through said slot;

mounting counter knife unit within each slot downstream from said primary knife;

providing said counter knife unit with a first series of chips contact elements for engaging the chips slices leaving said primary knife to reduce the size of said chips;

providing said counter knife unit with a second series of chip contact elements for engaging chips leaving the said first series of contact elements to further reduce the size of said chips.

* * * * *